US009067111B2

(12) United States Patent
Zdrazila

(10) Patent No.: US 9,067,111 B2
(45) Date of Patent: Jun. 30, 2015

(54) RACKET STRINGING MACHINE

(71) Applicant: Vaclav Zdrazila, Las Vegas, NV (US)

(72) Inventor: Vaclav Zdrazila, Las Vegas, NV (US)

( * ) Notice: Subject to any disclaimer, the term of this patent is extended or adjusted under 35 U.S.C. 154(b) by 101 days.

(21) Appl. No.: 13/867,278

(22) Filed: Apr. 22, 2013

(65) Prior Publication Data

US 2014/0315668 A1 Oct. 23, 2014

(51) Int. Cl.
*A63B 51/14* (2006.01)

(52) U.S. Cl.
CPC ..... *A63B 51/14* (2013.01)

(58) Field of Classification Search
CPC ..... A63B 51/14
USPC ..... 473/555–557
See application file for complete search history.

(56) References Cited

U.S. PATENT DOCUMENTS

| | | | | |
|---|---|---|---|---|
| 4,249,732 | A * | 2/1981 | Balaban | 473/556 |
| 4,326,713 | A * | 4/1982 | Balaban | 473/556 |
| 4,620,705 | A * | 11/1986 | Tsuchida | 473/557 |
| 7,192,370 | B2 * | 3/2007 | van der Pols | 473/557 |
| 7,980,968 | B1 * | 7/2011 | Erik Bernard | 473/557 |
| 2008/0167147 | A1 * | 7/2008 | Li | 473/557 |

* cited by examiner

*Primary Examiner* — Raleigh W Chiu
(74) *Attorney, Agent, or Firm* — Kevin Keener; Keener and Associates P.C.

(57) ABSTRACT

The invention is a machine for stringing rackets. The invention comprises a stringing machine utilizing a sliding spring within the pulling mechanism to allow for customized tension application. A user changes the tension in the stringing machine system by moving the slidable spring along the length of a tension transfer bar. The invention may optionally provide for a means for automatically locking the rotation of the mounting plate during the stringing process. The invention may optionally provide for a self-locking string clamp to be used on the machine for stringing rackets.

17 Claims, 11 Drawing Sheets

RACKET STRINGING MACHINE

TECHNICAL FIELD

The invention relates generally to a racket stringing machine and more specifically to a racket stringing machine utilizing a sliding tension spring. Optionally, the machine may also have an automatic mounting plate brake. The machine may also optionally utilize self-locking clamps for string retention during the stringing process.

BACKGROUND OF THE INVENTION

Tennis rackets are strung with the use of a stringing machine. FIG. 1 displays a standard embodiment of the prior art. A tennis racket 20 is placed in a mounting plate 60 and clamped in place. A string is threaded through grommets in the tennis racket. The string is held in place within the tennis racket by a string clamp. The free end of the string is threaded through a roller mounted within the tension head 140. The tension head 140 is incorporated with other items to comprise the tension head assembly 100. The tension head assembly 100 is mounted on the winder bar 40. The tension head assembly 100 includes a tension crank 120. Turning the tension crank 120 causes the tension head assembly 100 to move along the winder bar 40. When a string is threaded through the tension head 140, a user can turn the tension crank 120 to move the tension head 140 away from the mounting plate 60. This movement pulls on the string and creates the necessary tension in the string until it is secured in place on the racket 20.

The tension head assembly 100 is designed so that the tension in the string is set at a predetermined tension. Historically, in tennis racket stringing machines, this predetermined tension is accomplished by means of a precompressed spring 110 within the tension head assembly 100. The tension placed on the tension head 140 by the string is transferred to the precompressed spring 110 by means of a tension transfer bar 150. The tension transfer bar 150 operates as a simple lever, where the axel 145 of the tension head operates as the fulcrum and the distance between the axel 145 and the precompressed spring 110 and the axel 145 and the string are the respective arms of the lever. Traditionally, the ratio of these arms is fixed, thus the tension is changed or set by precompressing the spring 110. When the tension in the string multiplied by the distance of the string to the axel 145 matches the tension in the precompressed spring 110 multiplied by the distance of the spring 110 from the axel 145, the tension head 140 rotates along the axel 145, releasing the tension brake 130. The brake engages with the tension crank 120, preventing additional movement of the tension head assembly 100 along the winder bar 40.

The tension of the precompressed spring 110 can be manipulated and set by turning a knob 160 connected to the precompressed spring 110, causing the winding of the precompressed spring 110 to become looser or tighter. The precompressed screw is wound about a screw connected to the knob. Turning the screw changes the winding of the spring, which changes the tension. The distance of the precompression is normally very short. The screw, to which the knob 160 is mounted, and the precompressed spring 110 are set such that one unit, or partial unit, of turning changes the tension of the spring by one pound of force. Users in countries utilizing the metric system must purchase a machine set for kilograms instead of pounds since a change of tension in one pound of force is not equal to one kilogram of force. This presents a limitation. In addition, to make the distance of precompression greater, much larger spring would have to be used, which would not be practical. In addition, utilization of a precompressed spring 110 is limiting in that the spring becomes fatigued through repetitive use and constant tension. This fatigue can cause the tension in the strings attached to the racket 20 to decrease, decreasing the performance of the racket 20. Such fatigue also requires a user to take time to recalibrate the tension, lessening the effectiveness of the user and decreasing the rate of production. In addition, the fatigue of the spring requires that the spring be replaced on a frequent basis. What is needed is a means of allowing a user to set a tension on the string and the tension head 140 without utilizing a precompressed spring 110. What is needed is a tension scale large enough so a user can easily change the tension in the tension head and to adjust the tension between the English system and metric system of measurement as needed.

When a user strings a racket 20, the racket 20 is attached to the mounting plate 60. The mounting plate 60 rotates so that the user may turn the racket 20 as needed to thread a string through separate grommets. Historically, to prevent the mounting plate 60 from rotating during the threading process, a brake 70 has been installed that is utilized by a lever. When a user desires to prevent the mounting plate 60 from rotating, the user pulls a lever into a locking position, engaging the brake 70, and preventing the mounting plate 60 from rotating. Such a method is flawed. Utilizing a separate lever for locking the mounting plate 60 becomes burdensome during the stringing process. A user must lock and release the lever several times while maintaining the tension in strings which have been threaded. In addition, some users fail to engage the brake 70, leaving the mounting plate 60 movable during the stringing process. What is needed is a means of locking the mounting plate 60 in place during the stringing process without requiring a user to make additional movements.

In addition, historically, string clamps engage strings from below. In the prior art, the string clamp is positioned on a base clamp. The base clamp is positioned in the correct position on the mounting plate and then locked in place. The string clamp is then extended upwards until it engages the strings in the racket. The clamp closes in from the sides around the string until it presses the string within the clamp with sufficient pressure to prevent the string from slipping or moving. The end of the clamp is fashioned into a comb shape. This shape allows cross strings to be positioned between the fingers of the clamp during the stringing process. The prior art is limited in that the string clamp requires a user to engage two locks to utilize the clamp. The user must engage a base clamp lock and the string clamp lock. This requires additional time on the part of the user when utilizing the string clamp. Previous attempts at creating an automatic base clamp lock were either too complicated and thus unreliable, or utilized a self-locking torque feature. The self-locking torque feature utilized the string tension, which created sufficient torque on the clamp base to become self-locking This solution resulted in considerable play and required increased skill and attention of the stringer. What is needed is a simple self-locking base clamp lock which locks positionally in place when utilized.

SUMMARY OF THE INVENTION

The invention is a tennis racket stringing machine utilizing a slidable spring for creating the appropriate tension for the stringing process. The slidable spring may be housed within the tension head assembly or along the winder bar. The invention is utilized by changing the distance between the slidable spring and the axel to change the leverage force applied on the string. The change in the ratio of the fixed distance between the string and the axel to the changeable distance between the axel and the slidable spring allows a user to adjust the tension in the system simply by sliding the spring along the length of the tension transfer bar. In addition, the invention comprises a means for automatically locking the mounting plate through movement of the tension head assembly, which may or may not be utilized with the slidable spring option. Furthermore, the invention comprises a self-locking string clamp for use in the stringing process.

The invention is a racket stringing machine comprising a mounting plate, a tension head, a tension transfer bar, a slidable spring, a winder bar, and a tension crank. The winder bar may be a separate bar or part of the body of the stringing machine. The tension crank may create tension through either manual means or by means of an electric motor. In the invention the slidable spring may be positioned between winder bar and the tension transfer bar. The tension of the stringing system may be adjusted by moving the slidable spring along the length of the tension transfer bar. The stringing machine may further comprise a pulley, a tension pulling line, and a tension head lever. The ends of the tension pulling line are connected to the tension crank and the tension head lever. The tension head lever is also connected to the tension head. The tension pulling line freely engages with the pulley. The invention may further contain a brake trigger. The brake trigger releases the tension transfer bar when the tension applied by the tension head is substantially equal to the tension selected by means of the slidable spring.

In another embodiment of the invention, there is no use of a pulley system. In that embodiment, the tension transfer bar is connected to the tension head. The slidable spring is positioned against the tension transfer bar. The slidable spring and tension transfer bar may be housed within a tension head assembly. The tension of the stringing system may be adjusted by moving the slidable spring along the length of the tension transfer bar. The stringing machine may also contain a tension brake. The tension brake is connected between said tension crank and the tension head. The tension crank moves the tension head assembly along the winder bar or the body of the machine.

A user can use the invention to string a racket by placing a racket on a mounting plate, securing said racket to said mounting plate, threading a string through the grommets on the racket, securing the string within the racket with a string clamp, threading the free end of said string through a tension head, selecting the appropriate tension of the tension head by moving a slidable spring along a tension transfer bar, engaging a tension crank to apply tension to said string, and securing said string to said racket.

The invention may further utilize a means for automatically locking the rotation of the mounting plate when the tension head moves distal from the mounting plate.

The invention may optionally provide for a self-locking string clamp. The self-locking string clamp is comprised of a clamp bar which terminates in a shaped locking end and a string clamp which is movable along the length of the clamp bar. The invention further comprises a horizontal holder containing a shaped channel. The shaped channel is shaped to receive the shaped locking end of the clamp bar. The clamp bar is rotationally unmovable along the plane of the string bed when the shaped locking end is secure within the shaped channel.

DETAILED DESCRIPTION OF THE DRAWINGS

Figure 1:
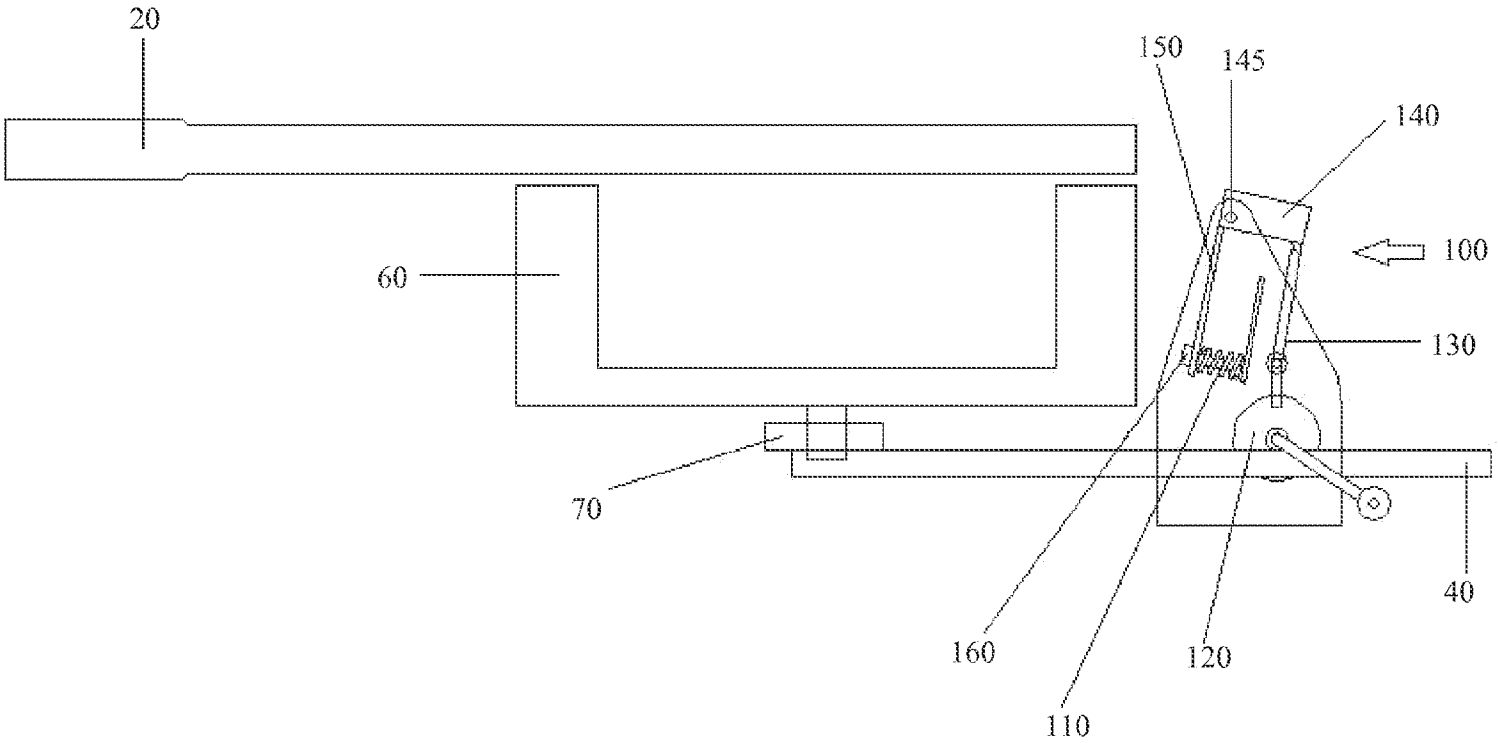
PRIOR ART Fig. 1
FIG. 1 is a side view of a standard embodiment of the prior art.

Although the present invention will be described with reference to the exemplary embodiments shown in the drawings, it should be understood that the present invention can be embodied in many alternate forms or embodiments. In addition, any suitable size, shape or type of elements or materials could be used.

Figure 2:
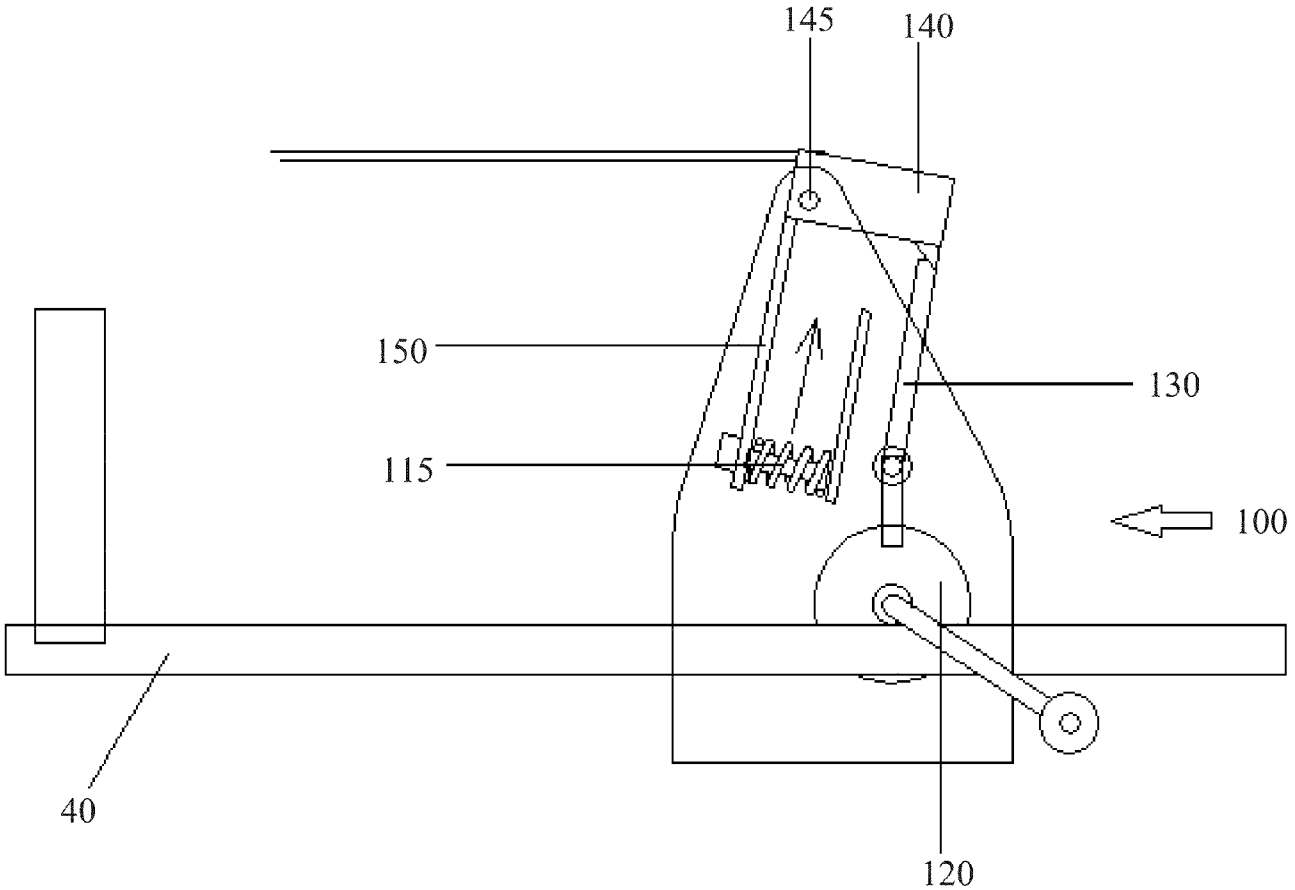
FIG. 2 is a side view of an embodiment of the invention where the slidable spring is located within the tension head assembly.

Referring to FIG. 2, the invention replaces a precompressed spring 110 with a slidable spring 115 which may move along the tension transfer bar 150. The slidable spring 115 may move proximate to the axel 145 or distal from the axel 145 along the tension transfer bar 150. The slidable spring 115 does not need to be precompressed, removing the tendency of the spring to fatigue through repetitive use. Optionally, the slidable spring may be compressed. Preferrably, the slideable spring is compressed to a slight degree. To change the applicable tension, a user may slide the slidable spring 115 along the tension transfer bar 150. Moving the slidable spring along the tension transfer bar changes the force and operation of the simple lever formed by the tension transfer bar and the axel. A user may begin with a standard tension where the slidable spring 115 is positioned distal from the axel 145. When a user moves the slidable spring distal from the axel 145, the distance of the spring 115 from the axel 145 is increased, while the distance of the string from the axel 145 remains the same. Therefore the ratio of the simple lever changes resulting in a greater tension needed to trigger the tension brake 130. As a user moves the slidable spring 115 proximate to the axel 145, the distance of the spring 115 from the axel 145 is decreased, while the distance of the string from the axel 145 remains the same. Therefore the ratio of the simple lever changes, resulting in lower tension needed to trigger the tension brake 130. This causes a relatively smaller amount of tension to be placed in the string in the racket. Thus, to increase the tension, a user moves the slidable spring 115 distal to the axel 145. To decrease the tension a user moves the slidable spring 115 proximate from the axel 145.

Figure 3:
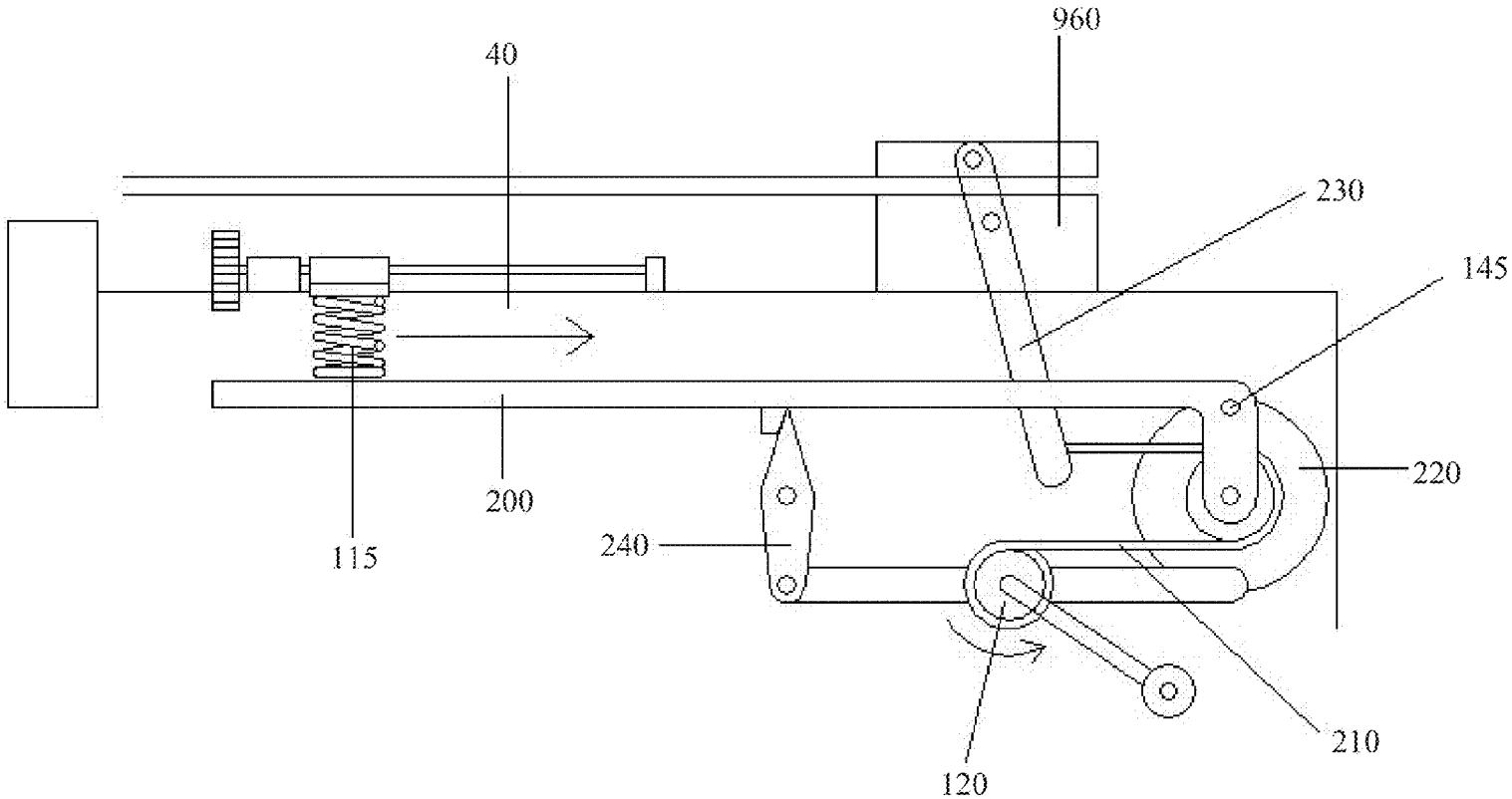
FIG. 3 is a side view of an embodiment of the invention where the slidable spring is located positioned along the winder bar.

Referring to FIG. 3, another embodiment of the invention is shown. In this embodiment, the tension head assembly is incorporated into the machine base. In this embodiment the slidable spring 115 slides along the winder bar 40. The winder bar 40 in this embodiment is also the machine base. The free end of the slidable spring 115 is in contact with the tension transfer bar 200. On the other end of the tension transfer bar 200 a simple pulley 220 is mounted. The tension transfer bar 200 is pivotally mounted on an axel 145 between the pulley 220 and the spring 115. Thus the tension transfer bar 200 forms a simple lever, with the axel 145 being the fulcrum, and the distance between the spring 115 and the axel 145 and the distance from the pulley 220 to the axel 145 being the respective arms of the lever. In this embodiment, a user pulls tension on the string by turning the tension crank 120. The tension crank 120 is connected to a tension pulling line 210. The tension pulling line 210 may be formed from any line, string, chain, or belt. Turning the tension crank 120 causes the tension pulling string 210 to wind around the tension crank 120. Optionally the tension pulling line 210 is moved by a sprocket mounted on the tension crank 120. The tension pulling line 210 extends from the tension crank 120, wraps against the external surface of the pulley 220, and attaches to a tension head lever 230. The opposite end of the tension head lever 230 attaches to the string gripper 960. The string gripper 960 is the part of the tension head 140 from the prior embodiment that engages the string during the stringing process. To apply tension to the string, a user turns the tension crank 210. The turning of the tension crank 120 shortens the tension pulling line 210. The opposite end of the tension pulling line pulls against the tension head lever 230, pulling the string gripper 960 to the distal end of the winder bar 40. Shortening the tension pulling line 210, causes tension to be applied to the pulley 220 which causes the tension transfer bar 200 to compress into the slidable spring 115. When the tension in the pulley 220 multiplied by the distance of the pulley 220 from the axel 145 matches the tension set with the slidable spring 115 multiplied by the distance of the slidable spring 115 from the axel 145, the tension transfer bar 200 rotates around the axel 145 compressing the spring 115 and releasing the brake trigger 240. With the brake now engaged, the tension crank 120 becomes locked in place.

The tension in the system may be adjusted by moving the slidable spring 115 along the winder bar 40 which changes the ratio of the distance between the spring 115 and the axel 145 and the distance between the axel 145 and the pulley 220. When the slidable spring 115 is moved distal from the axel 145, the distance between the spring 115 and the axel 145 is increased and more tension is required to move the tension transfer bar 200 against the slidable spring 115 a sufficient length to engage the brake trigger 240. As the slidable spring 115 is moved along the tension transfer bar 200 toward the axel 145, the distance between the spring 115 and the axel 145 is shortened. In this instance less tension is required to move the tension transfer bar 200 a sufficient distance against the slidable spring 115 to engage the brake trigger 240. In short, to increase the tension applied to a racket string, a user moves the slidable spring 115 distal to the axel 145. To decrease the tension applied to a racket string, a user moves the slidable spring 115 proximate to the axel 145.

When using any embodiment of the invention to string a racket 20, a user places a racket 20 on the mounting plate 60 and secures said racket 20 to the mounting rack 60. The user threads the string through the grommets on the racket 20. The user secures the string within the racket 20 by means of a string clamp. The user threads the free end of the string through the tension head 140 and secures the string to said tension head 140. The user selects the appropriate tension by moving the slidable spring 115 to the desired location along the tension transfer bar 200. The user engages the tension crank 120 to apply tension to the string. In one embodiment the tension crank 120 may be manually operated. In a separate embodiment the tension crank 120 may be operated with use of an electric motor. When the tension head 140 applies the appropriate tension to the string the user secures the string to the racket.

Figure 4:
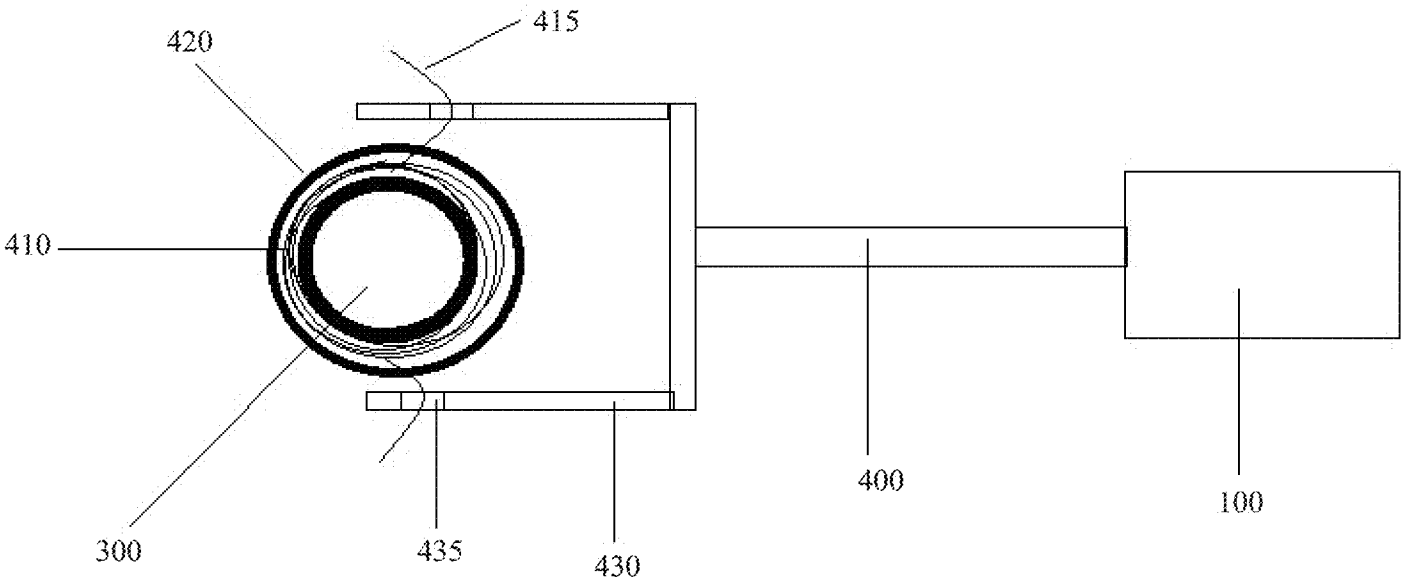
FIG. 4 is a top view of one embodiment of the automatic mounting plate brake.

The invention further comprises a means for automatically locking the mounting plate, preventing the mounting plate from rotating, when the tension head is moved to apply tension to the racket string. Said means can be provided in a number of ways. FIG. 4 displays an embodiment of the means for automatically locking the mounting plate. In this embodiment, a pair of torsion springs 410 are wound about the axel. One end of each torsion spring is engaged in a fixed external collar 420 surrounding the axel 300. The opposite end of each torsion spring 415 extends through a respective slot in the fixed external collar 420 and terminates beyond the external collar 420. A brake lever 400 is attached to the tension head assembly 100. A spring engagement head 430 is attached to the opposite end of the brake lever 400. The spring engagement head 430 contains fixed slots 435 which engage the free ends 415 of the torsion springs. As the tension head assembly 100 is moved toward the mounting plate, the fixed slots 435 engage both free ends 415 of the torsion springs 410. As the torsion springs 410 are engaged, the free ends 415 slide in their respective slots in the fixed external collar 420. When the free ends 410 slide, the torsion springs 410 open and remove tension from the axel 300, permitting the axel 300 to move freely. When the tension head assembly 100 is moved away from the mounting plate, the fixed slots 435 disengage from the free ends 415 of the torsion springs 410. This permits the torsion springs 410 to tighten around the axel 300. The tension placed on the axel 300 is sufficient to prevent the axel 300 from rotating. The torsion springs 410 are placed on the axel 300 and have different windings. For example, when viewed from above, one torsion spring 410 would be wound clockwise and the other torsion spring 410 would be wound counterclockwise. When the torsion springs 410 are disengaged, the rotation of the axel 300 in either direction will cause the winding of one of the torsion springs 410 to tighten. This tightening increases the friction placed on axel 300, thus preventing the axel 300 and mounting plate from rotating.

Figure 5:
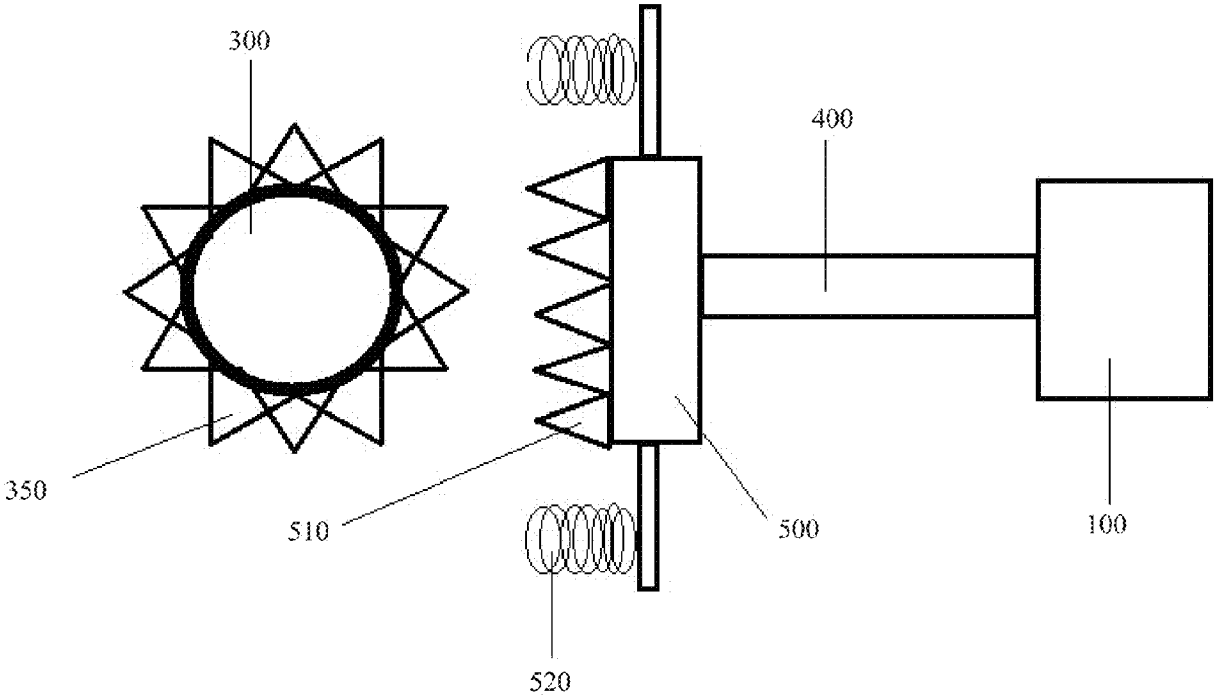
FIG. 5 is a top view of another embodiment of the automatic mounting plate brake.
Figure 6:
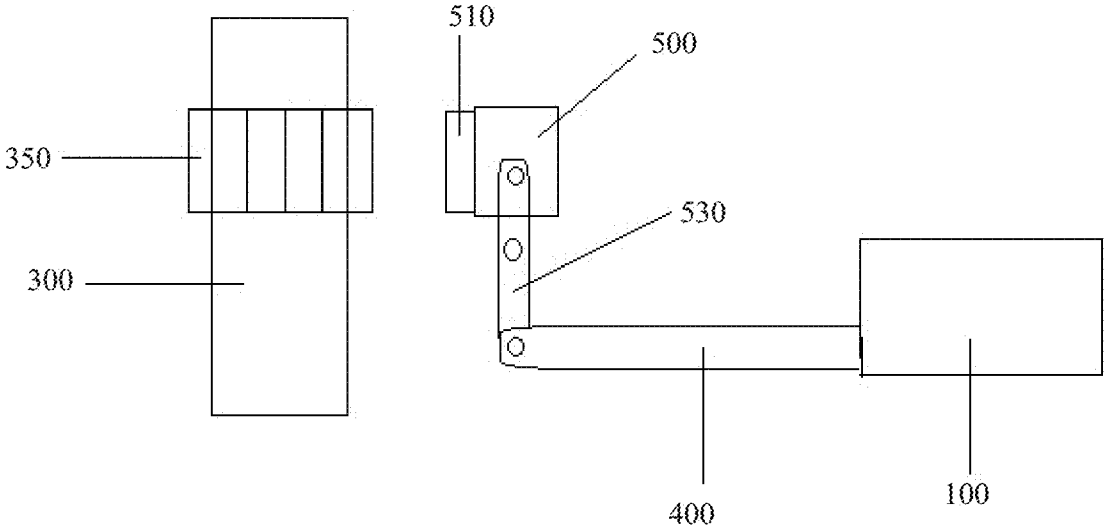
FIG. 6 is a side view of an embodiment of the automatic mounting plate brake.

Referring to FIGS. 5-6, another embodiment of the automatically locking means is displayed. In this embodiment, the axel 300 contains an external fixed axel gear 350. The brake lever 400 attached to the tension head assembly 100 attaches to a pivot bar 530. The opposite end of the pivot bar 530 contains a locking gear 500. The locking gear 500 contains a plethora of teeth 510 that are complementary to the teeth of the fixed axel gear 350. As the tension head assembly 100 is moved toward the mounting plate the pivot causes the locking gear 500 to disengage from the fixed axel gear 350. When disengaged, the axel 300 is free to rotate. As the tension head assembly 100 is moved away from the mounting plate, the pivot causes the locking gear 500 to engage the fixed axel gear 350. When the locking gear 500 engages the fixed axel gear 350 the axel 300 is locked in place and the axel 300 may not rotate. Optionally, the embodiment may include springs 520 attached to the locking gear 500. The springs 520 may push against the base of the mounting plate or body of the stringing machine, causing the locking gear 500 to default into an unlocked position.

Figure 7:
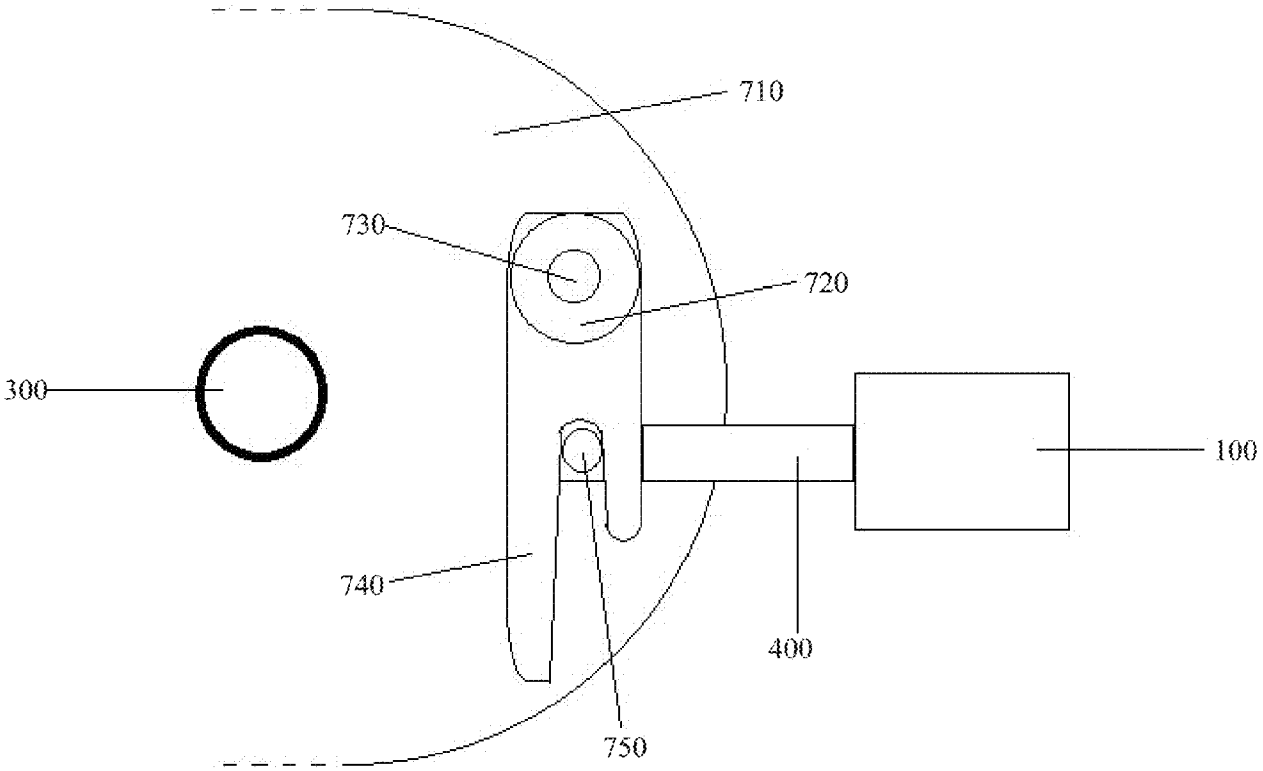
FIG. 7 is a top view of another embodiment of the automatic mounting plate brake.

Referring to FIG. 7, another embodiment of the automatically locking means is displayed. In this embodiment, a disc brake 710 is positioned around the axel 300. The brake lever 400 that is attached to the tension head assembly 100 is attached to a brake pad 720. The brake pad 720 is attached to the disc brake 710 by a central screw 730. As the tension head assembly 100 moves away from the mounting plate, the brake lever 400 rotates the arm 740 of the brake pad by utilizing a pin 750, which is attached to the brake lever 400 and which transfers the linear motion of the tension head assembly 100 to the rotating motion of the arm 740. This rotation transfers to the screw 730 connecting the brake pad 720 to the disc brake 710. The rotation of the screw 730 is such that the brake pad 720 further engages the disc brake 710 and prevents the axel 300 from rotating. As the tension head assembly 100 is moved toward the mounting plate, the brake lever 400 rotates the arm 740 of the brake pad in the opposite direction. This counter rotation transfers to the screw 730 connecting the brake pad 720 to the disc brake 710. This counter rotation is such that the brake pad 720 disengages from the disc brake 710, permitting the axel 300 to freely move. The open design of the arm 740 allows the de-coupling of the pin 750 from the arm 740. This permits further travel of the tension head assembly 100 away from the mounting plate, and it also allows re-coupling of the pin 750 to the arm 740, once the tension head assembly 100 moves back toward the mounting plate.

Figure 10:
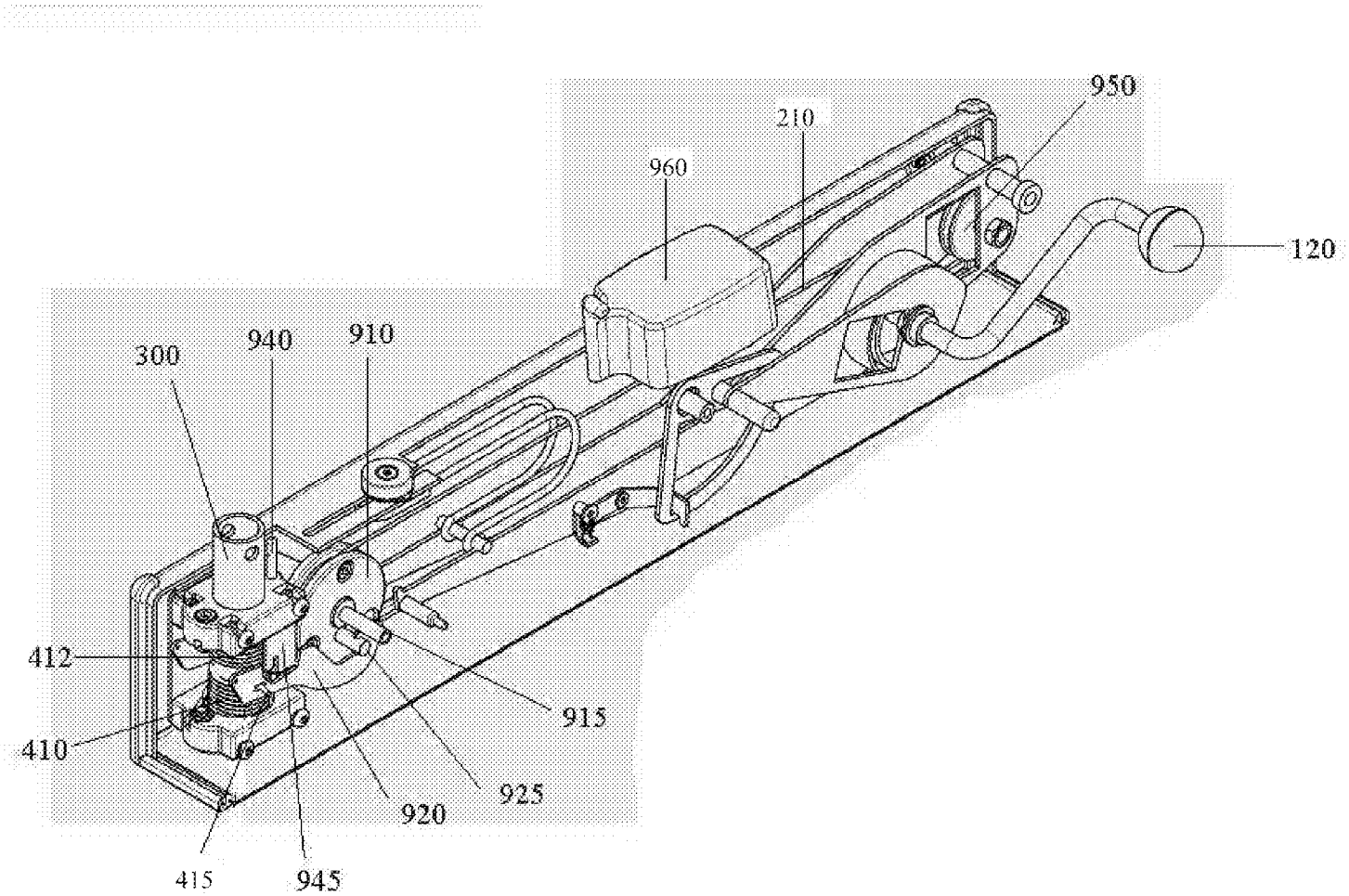
FIG. 10 is a perspective view of the preferred embodiment of the automatic mounting plate brake.

FIG. 10 displays the preferred embodiment of the automatically locking means. In this embodiment, a tension crank 120 is connected to a brake pulley 910 and a string gripper 960 by means of a tension pulling line 210. A string gripper 960 is the part of the tension head which grips the string. The other parts of the tension head in this embodiment are incorporated into the machine base. The tension pulling line 210 is secured on the opposite end from the brake pulley 910 by a simple pulley 950. The automatic braking means is accomplished by two torsion springs 410, 412 wound in opposite directions which are wound around the mounting plate axel 300.

As the tension crank 120 is turned counterclockwise, the tension pulling line 210, which is threaded around a brake pulley 910, pulls the string gripper 960 toward the mounting plate axel 300, on which the mounting plate with the racket is attached. As the brake pulley 910 rotates around the brake pulley axel 915, a pulling axel 925, which is inserted into the brake pulley 910, couples with the spring pulling element 920, which pulls on the axial braking spring 410 by the spring's end 415, which is inserted through an opening at the end of the spring pulling element 920. This action opens the axial braking spring 410 and the mounting plate axel 300 is free to rotate in one direction. At the same time another spring pulling element on the opposite side pulls the other axial braking spring 412 so the mounting plate axel 300 is free to rotate in the other direction as well. The brake pulley 910 rotates until the pulling axel 925 turns to a position slightly above the three o'clock position. At this point the top edge of the spring pulling element 920 engages the brake pulley axle 915. At this position the brake pulley 910 cannot rotate any further and becomes fixed, leaving both axial braking springs 410, 412 in the open position.

As the tension crank 120 is turned clockwise, the tension pulling line 210, which is threaded around the pulley 950, pulls the string gripper 960 away from the mounting plate axel 300, on which the mounting plate with the racket is attached. At the same time, the brake pulley 910 rotates clockwise, moving the pulling axel 925 in a clockwise fashion. The pulling axel 925 disengages from the spring pulling elements 920 releasing the spring pulling elements 920 toward the torsion springs 410, 412. This movement allows the spring pulling elements 920 to release the ends 415 of the torsion springs 410, 412. The torsion springs 410, 412 then provide a sufficient tension on the axel 300 so as to lock the rotational movement of the mounting plate axel 300. As the brake pulley 910 rotates further, the pulling axle 925 decouples from the pulling elements 920 and allows the brake pulley 910 to rotate a full revolution. This in turn allows the string gripper 960 to travel far enough away from the racket to tension the string.

When, by using the tension crank 120, the spring pulling elements 920 engage the torsion springs 410, 412 and pull the torsion springs 410, 412 into the open position, an automatic brake deactivation rod 940 can be pushed down. The automatic brake deactivation rod 940 is connected to a spring locking plate 945. Slots in the spring locking plate 945 are shaped to receive the ends 415 of the torsion springs 410, 412. When the spring locking plate 945 engages the ends 415 of the torsion springs 410, 412, the torsion springs 410, 412 are fixed in the open position. This allows the mounting plate axel 300 to rotate freely in either direction. When the torsion springs 410, 412 are deactivated by the spring locking plate 945, the pulling axle 925 decouples from the pulling elements 920 when the tension crank 120 is turned clockwise. This allows the brake pulley 910 to rotate a full turn, permitting a user to string a racket with the mounting plate in an unlocked position.

In another embodiment, the tension head may be moved by means of an electrical motor. In this embodiment, an electromagnetic brake is attached to the axel. When a signal is sent to the tension head motor to cause tension to be applied to the racket string, a second signal is simultaneously sent to the electromagnetic brake. This signal causes the electromagnetic brake to engage the axel, locking the axel in place and preventing the mounting plate to rotate. When a signal is sent to the tension head motor to remove tension from the racket sting, a second signal is simultaneously sent to the electromagnetic brake to disengage the axel. When the electromagnetic brake is disengaged from the axel, the axel is free to rotate, permitting the mounting plate to rotate.

Figure 8:
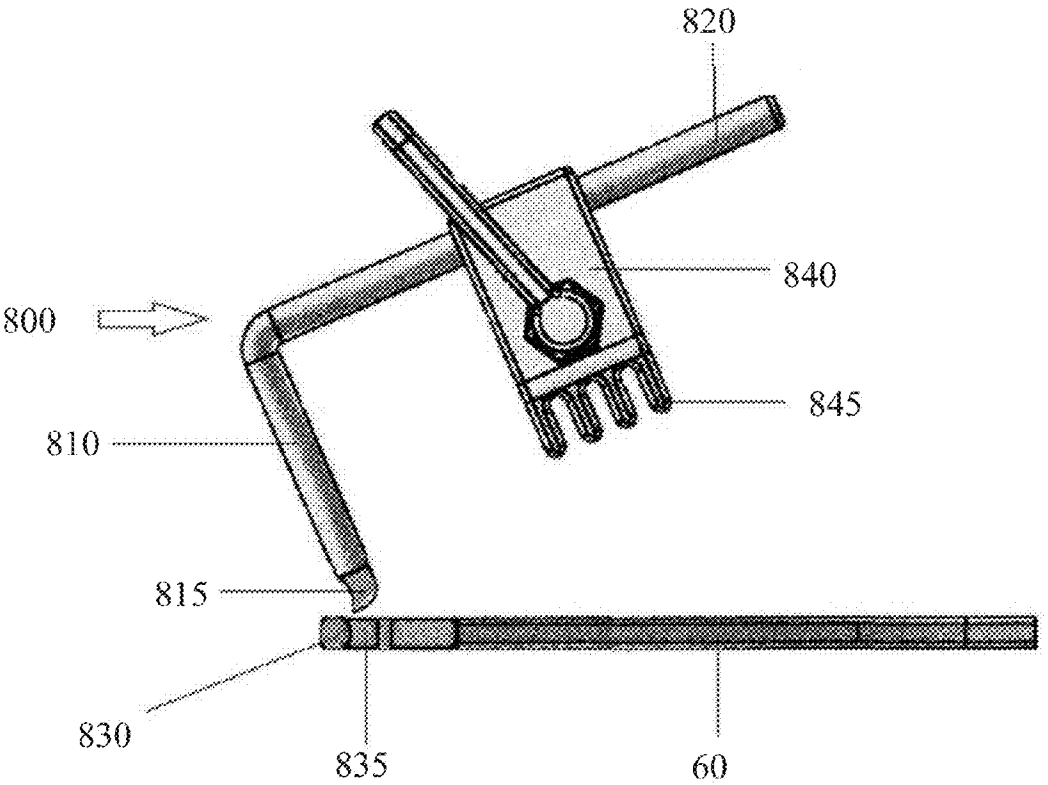
FIG. 8 is a side view of the self-locking string clamp.
Figure 9:
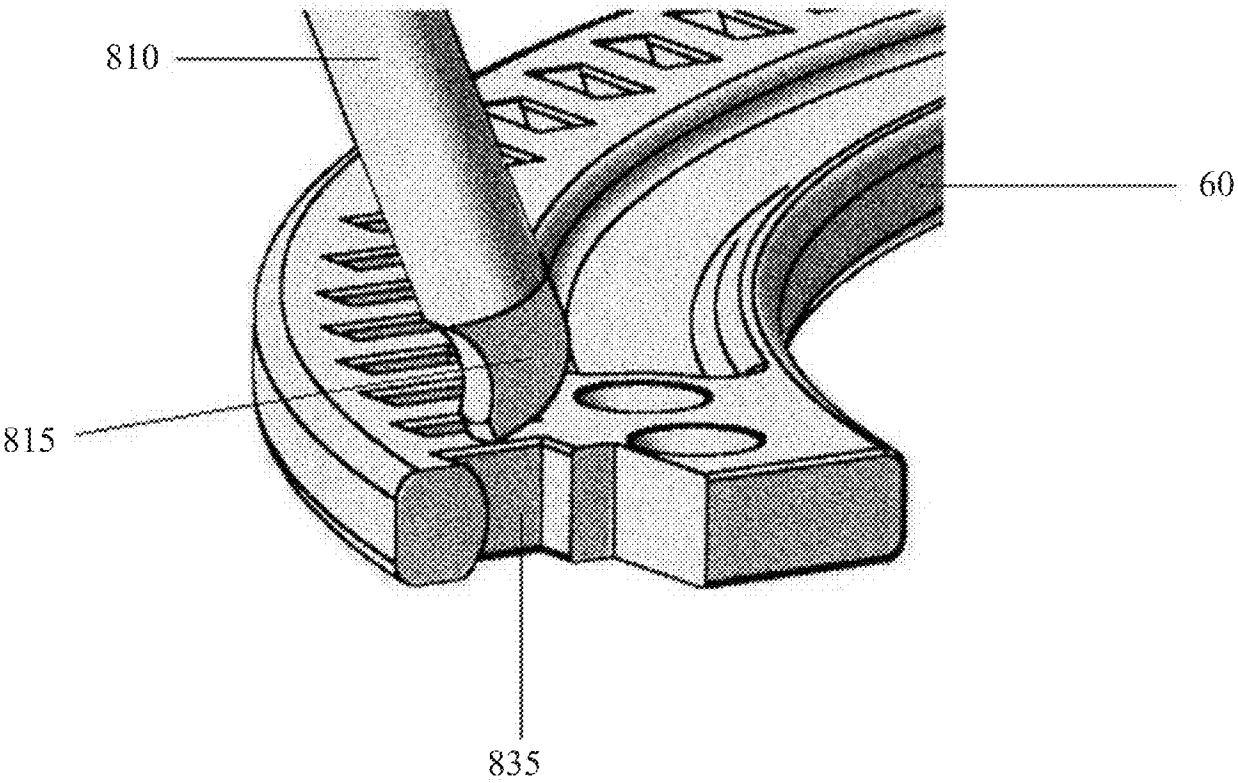
FIG. 9 is a perspective view of a part of the self-locking clamp.

In addition, the racket stringing machine optionally utilizes a self-locking string clamp to engage the strings. Referring to FIGS. 8-9, the self-locking string clamp is positioned on a horizontal holder 830 extending from the mounting plate 60. Optionally, the horizontal holder 830 may also be a part of the mounting plate 60. The horizontal holder 830 contains a shaped channel 835 for receiving the locking end of a clamp bar 800. In the embodiment shown, the clamp bar 800 has two members, a vertical member 810 and a horizontal member 820. The vertical member 810 extends from the horizontal member 820 at a roughly ninety degree angle. In other embodiments the clamp bar 800 could be of any shape or angle. In other embodiments the clamp bar 800 could be one continuous curved shape, a half circle, or the members may be at any angle. The end of the vertical member 810 terminates in a shaped locking end 815. The shaped locking end 815 is shaped such that the shape fits within the shaped channel 835 in the horizontal holder 830. The horizontal member 820 extends through a channel in the string clamp 840. The string clamp 840 is freely movable along the length of the horizontal member 820. The string clamp 840 is comprised of two sides which close around and secure a string during the stringing process. The end of the string clamp 840 is fashioned into a comb shape. The comb has a plethora of fingers 845. The shape is such that cross strings are permitted to extend through the fingers 845 of the comb during the stringing process.

When utilizing the invention, a user positions the shaped locking end 815 within the shaped channel 835. The shaped locking end 815 fits within the shaped channel 835 such that the shaped locking end 815 sufficiently fills the volume of the shaped channel 835. The shape of the shaped locking 815 end is complementary to the shape of the shaped channel 835. The shape of the shaped channel 835 and the shape of the shaped locking end 815 may be formed in a plethora of shapes. The shapes must be sufficiently complementary. In this embodiment the shapes allow the locking end 815 to be inserted in the shaped channel at an angle. This allows the string clamp 840 to remain above the string bed during placement. As the locking end 815 is tilted to a vertical position and fully inserted into the shaped channel 835, the horizontal member 820 rotates to the horizontal position, lowering the string clamp 840 to the level of the string bed. When the locking end 815 is fully inserted into the shaped channel 835, the locking end 815 forms a positive lock within the shaped channel 835. This prevents the rotational movement of the string clamp 840 along the plane of the string bed. After the string clamp 840 is lowered to the string level, the shapes provide sufficient resistance to prevent additional rotational movement of the shaped locking end 815. When the shaped locking end 815 is placed within the shaped channel 835 the edges of the shaped channel 835 prevent additional rotational movement of the shaped locking end 815. This prevents the rotational movement of the clamp bar 800. A user positions the string clamp 840 in the proper placement along the length of the horizontal member 820 as the string clamp 840 is tilted over the string bed. The string clamp 840 is secured to the horizontal member 820 by means of a friction brake. The string clamp 840 may utilize the same securing process to secure the horizontal member 820 and string at the same time. In this instance a user will only need to engage the string clamp 840 once to secure the string clamp 840 to both the horizontal member 820 and the string. Optionally the string clamp 840 may utilize different means to secure the string clamp 840 to the horizontal member 820 and the string. In this instance the user will need to engage the means of securing the string clamp 840 to the horizontal member 840 and then engage the means of securing the string clamp 840 to the string.

Preferrably, the respective parts of the racket stringing machine are made from metal. In other embodiments, the respective parts of the racket stringing machine may be formed from any polythermal plastics. In other embodiments, respective parts may be formed from metal while others are formed from polythermal plastics.

Figure 11:
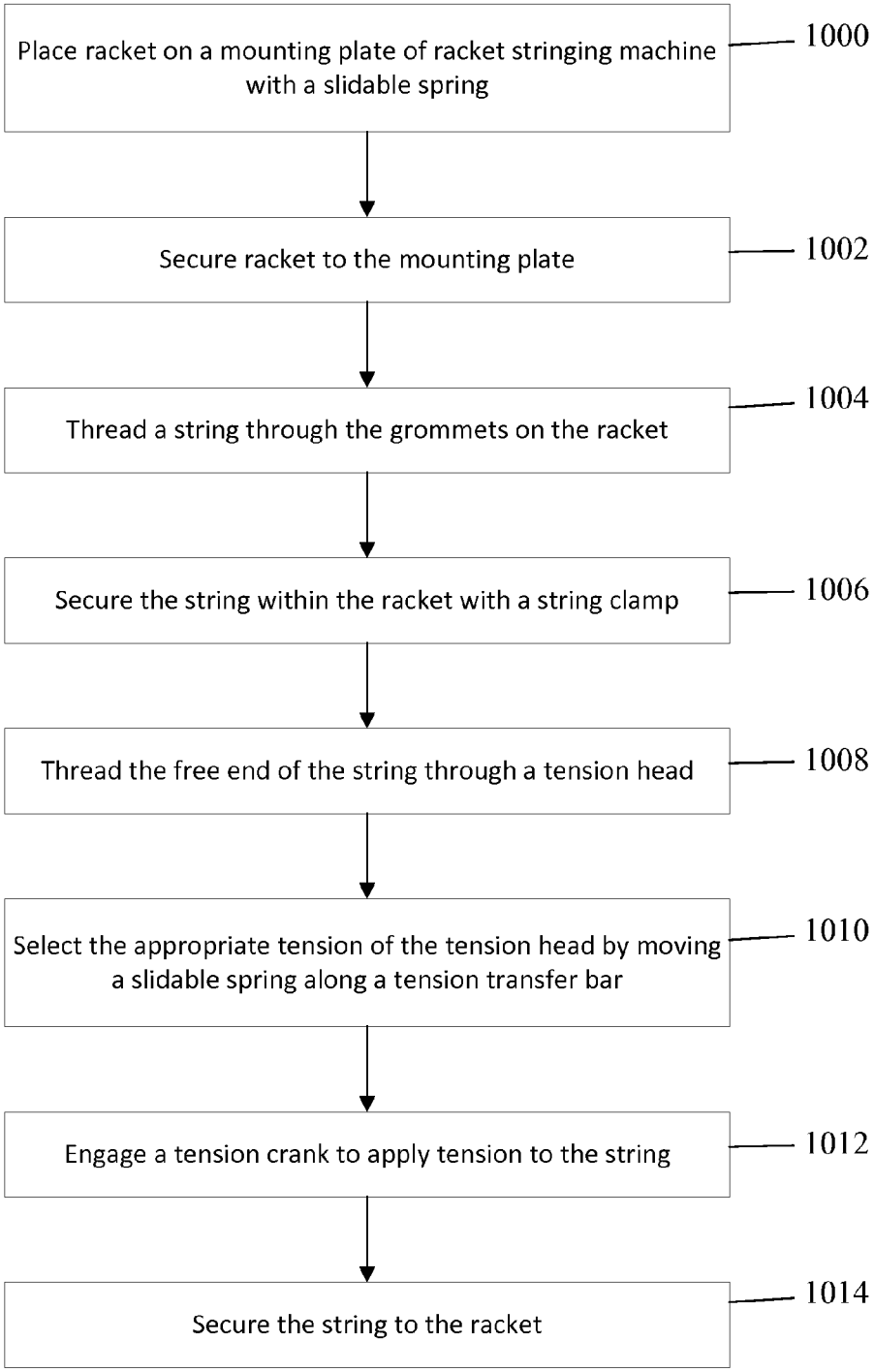
FIG. 11 is a flow diagram of the method of utilizing the invention.

Referring to FIG. 11, the method of utilizing the invention is displayed. A user begins by placing a racket on a mounting plate of racket stringing machine with a slidable spring 1000. The user then secures the racket to the mounting plate 1002. Next the user threads a string through the grommets on the racket 1004. The user then secures the string within the racket string clamp 1006. The user then threads the free end of the string through a tension head 1008. The user then selects the appropriate tension of the tension head by moving the slidable spring along the tension transfer bar 1010. The user then engages the tension crank to apply tension to the string 1012. Finally, the user secures the string to the racket 1014.

The invention claimed is:

1. A racket stringing machine comprising
A mounting plate
A tension head
A tension transfer bar
A slidable spring
Said slidable spring having a first end and a second end
Wherein said first end of said slidable spring is coupled to said tension transfer bar
A winder bar
Wherein said winder bar is coupled to said mounting plate
A tension crank
Wherein said tension crank is coupled to said winder bar
Wherein said tension crank is coupled to said tension head
Wherein said tension crank is coupled to said tension transfer bar.

2. The device as in claim 1
Wherein said second end of said slidable spring is coupled to said winder bar.

3. The device as in claim 2
Wherein the tension of the stringing system may be adjusted by moving the slidable spring along the length of the tension transfer bar.

4. The device as in claim 3 further comprising
A pulley
Wherein said pulley is coupled to said tension transfer bar
A tension pulling line
Said tension pulling line having a first end and a second end
A tension head lever
Wherein said first end of said tension pulling line is connected to said tension crank and said second end of tension pulling line is connected to said tension head lever
Wherein said tension head lever is connected to said tension head
Wherein said tension pulling line freely engages with said pulley.

5. The device as in claim 4 further comprising
A brake trigger
Wherein said brake trigger is coupled to said tension crank.

6. The device as in claim 5
Wherein the brake trigger releases the tension transfer bar when the tension applied by the tension head is substantially equal to the tension selected by means of the slidable spring.

7. The device as in claim 1 wherein the tension transfer bar is connected to said tension head.

8. The device as in claim 7
Wherein the slidable spring is positioned against the tension transfer bar within a tension head assembly
Wherein said tension head assembly is coupled to said winder bar.

9. The device as in claim 8
a. Wherein the tension of the stringing system may be adjusted by moving the slidable spring along the length of the tension transfer bar.

10. The device as in claim 9
a. Further comprising a tension brake
i. Wherein said tension brake is connected between said tension crank and said tension head.

11. The device as in claim 10 wherein said tension crank moves said tension head assembly along the length of said winder bar.

12. The device as in claim 1 further comprising a self-locking string clamp
Wherein said self-locking string clamp is removeably coupled to said mounting plate.

13. The device as in claim 12 wherein said self-locking string clamp comprises
A clamp bar
Said clamp bar terminating in a shaped locking end
A string clamp
Said string clamp movable along the length of the clamp bar.

14. The device as in claim 13 further comprising

A horizontal holder

Wherein said horizontal holder is coupled to said mounting plate

Said horizontal holder containing a shaped channel

Said shaped channel shaped to receive said shaped locking end of the clamp bar.

15. The device as in claim 14

Wherein the clamp bar is rotationally unmovable along the plane of the string bed when said shaped locking end is secure within said shaped channel.

16. A racket stringing machine comprising

A mounting plate

A tension head

A winder bar

Wherein said winder bar is coupled to said mounting plate

Wherein said winder bar is coupled to said tension head

A means for automatically locking the rotation of said mounting plate when said tension head moves distal from the mounting plate along the length of said winder bar Wherein said locking means is coupled to said mounting plate.

17. The method of stringing a racket comprising utilizing a racket stringing machine with a slidable string comprising Placing a racket on a mounting plate Securing said racket to said mounting plate Threading a string through the grommets on the racket Securing the string within the racket with a string clamp Threading the free end of said string through a tension head Selecting the appropriate tension of the tension head by moving a slidable spring along a tension transfer bar Engaging a tension crank to apply tension to said string Securing said string to said racket.

* * * * *